US009480339B2

(12) United States Patent
Cvek

(10) Patent No.: US 9,480,339 B2
(45) Date of Patent: Nov. 1, 2016

(54) SEAT WITH PELVIC SUPPORT

(71) Applicant: Sava Cvek, Jamaica Plain, MA (US)

(72) Inventor: Sava Cvek, Jamaica Plain, MA (US)

( * ) Notice: Subject to any disclaimer, the term of this patent is extended or adjusted under 35 U.S.C. 154(b) by 142 days.

(21) Appl. No.: 14/133,502

(22) Filed: Dec. 18, 2013

(65) Prior Publication Data

US 2014/0183914 A1 Jul. 3, 2014

Related U.S. Application Data

(60) Provisional application No. 61/747,588, filed on Dec. 31, 2012.

(51) Int. Cl.

| | |
|---|---|
| ***A47C 7/02*** | (2006.01) |
| ***A47C 7/28*** | (2006.01) |
| ***A47C 9/00*** | (2006.01) |

(52) U.S. Cl.

CPC ..... *A47C 7/022* (2013.01); *A47C 7/282* (2013.01); *A47C 9/002* (2013.01)

(58) Field of Classification Search

CPC ..... A47C 7/282; A47C 7/28; A47C 7/32; A47C 7/022; A47C 7/02; A47C 9/002

USPC ..... 297/452.56, 452.63, 452.15, 452.18, 297/285, 452.48

See application file for complete search history.

(56) References Cited

U.S. PATENT DOCUMENTS

| | | | |
|---|---|---|---|
| 3,178,221 | A | 4/1965 | Schwarz |
| 3,197,789 | A | 8/1965 | Ashkouti et al. |
| 3,258,259 | A | 6/1966 | Bohlin |
| 3,353,869 | A | 11/1967 | Getz et al. |
| 3,529,866 | A | 9/1970 | Getz |
| 3,614,159 | A | 10/1971 | Christin |
| 3,647,260 | A | 3/1972 | Grant et al. |
| 4,018,479 | A | 4/1977 | Ball |
| 4,465,317 | A | 8/1984 | Schwarz |
| 4,712,834 | A | 12/1987 | Warrick |
| 4,810,033 | A | 3/1989 | Kemmann |
| 4,880,272 | A | 11/1989 | Brauning |
| 5,076,643 | A | 12/1991 | Colasanti et al. |
| 5,190,348 | A | 3/1993 | Colasanti |
| 5,338,091 | A | 8/1994 | Miller |
| 5,383,712 | A | 1/1995 | Perry |
| 5,772,282 | A | 6/1998 | Stumpf et al. |
| 5,868,466 | A | 2/1999 | Massara et al. |
| 6,158,815 | A | 12/2000 | Sugie et al. |
| D449,174 | S | 10/2001 | Neil |
| 6,354,662 | B1 | 3/2002 | Su |

(Continued)

*Primary Examiner* — Milton Nelson, Jr.
(74) *Attorney, Agent, or Firm* — Thomas P. O'Connell; O'Connell Law Firm

(57) ABSTRACT

A seat with pelvic support having a seat bottom, a panel of elastomeric material retained under an initial tension spanning a framework of the seat bottom, and a resiliently deflectable pelvic support structure retained in spaced relation from the panel of elastomeric material. The resiliently deflectable pelvic support structure provides supplemental support to the seat occupant when the panel of elastomeric material is sufficiently deflected. The resiliently deflectable pelvic support structure can be formed by a plurality of resiliently deflectable fingers. The fingers, which can have different deflection resistances to establish hyper-localized resistance control, can project outboard from a central member or inboard from the framework. A U-shaped rigidifying member can be secured to the framework, and a seat back can retain a support and positioning member in a fixed angular orientation relative to the seat bottom.

14 Claims, 14 Drawing Sheets

(56) References Cited

U.S. PATENT DOCUMENTS

| | | | | |
|---|---|---|---|---|
| 6,386,634 | B1 | 5/2002 | Stumpf et al. | |
| 6,394,546 | B1 | 5/2002 | Knoblock et al. | |
| 6,550,866 | B1 * | 4/2003 | Su | A47C 7/742 297/440.11 |
| 6,575,530 | B1 | 6/2003 | Fischer et al. | |
| 6,588,842 | B2 | 7/2003 | Stumpf et al. | |
| 6,942,300 | B2 | 9/2005 | Numa et al. | |
| 6,966,604 | B2 | 11/2005 | Stumpf et al. | |
| 6,983,997 | B2 | 1/2006 | Wilkerson et al. | |
| 7,066,537 | B2 | 6/2006 | Coffield et al. | |
| 7,249,802 | B2 | 7/2007 | Schmitz et al. | |
| 7,251,917 | B2 | 8/2007 | Cvek | |
| 7,347,495 | B2 | 3/2008 | Beyer et al. | |
| 7,396,077 | B2 | 7/2008 | Boulva | |
| 7,419,222 | B2 | 9/2008 | Schmitz et al. | |
| 7,517,024 | B2 | 4/2009 | Cvek | |
| 7,530,640 | B2 | 5/2009 | Walters et al. | |
| 7,731,295 | B2 | 6/2010 | Lin | |
| 7,806,478 | B1 | 10/2010 | Cvek | |
| 7,878,590 | B1 | 2/2011 | Bilak et al. | |
| 8,602,494 | B2 | 12/2013 | Cvek | |
| 2001/0043003 | A1 | 11/2001 | Knoblock et al. | |
| 2005/0017565 | A1 | 1/2005 | Sprouse, II | |
| 2005/0052061 | A1 | 3/2005 | Deimen et al. | |
| 2005/0062323 | A1 | 3/2005 | Dicks | |
| 2005/0242652 | A1 | 11/2005 | Kepler et al. | |
| 2007/0102987 | A1 * | 5/2007 | Chen | A47C 7/282 297/452.56 |
| 2008/0315661 | A1 * | 12/2008 | Lin | A47C 7/282 297/452.56 |
| 2011/0198903 | A1 * | 8/2011 | Sebastian | G09F 21/04 297/219.11 |
| 2012/0061988 | A1 | 3/2012 | Jaranson et al. | |

* cited by examiner

SEAT WITH PELVIC SUPPORT

FIELD OF THE INVENTION

The present invention relates generally to seating. More particularly, disclosed herein are pelvic support and positioning devices for seats with elastomeric material.

BACKGROUND OF THE INVENTION

Resilient mesh has become an increasingly common fabric for use in seating and other applications. In furniture applications, the mesh is retained, typically under tension, by a peripheral framework. Mesh retained in such a manner has been employed as the sole support surface and in combination with subsidiary support surfaces in back, seat, and other furniture components. The present inventor has contributed to this art with a plurality of inventions, including the Elastomeric Material Application System disclosed in U.S. Pat. No. 6,996,895, the Methods and Arrangements for Securing Fabric of U.S. Pat. No. 7,251,917, Post-Assembly Tension Adjustment in Elastomeric Material Applications as taught by U.S. Pat. No. 7,517,024, and the Task Chair with Dual Tilting Capabilities disclosed and protected by U.S. Pat. No. 7,806,478.

The use of resilient mesh in furniture support applications has been found to be advantageous for a number of reasons. In addition to the modern and clean appearance that mesh support panels provide, mesh is advantageous for its breathability. Resilient mesh also reduces areas of discomfort and excess pressure. Moreover, resilient mesh can be retained and potentially adjusted to have varied degrees of tension thereby to provide varied degrees of support for different areas of a person's body.

However, the use of elastomeric material as a support surface in seating has presented a number of design challenges. By way of example, it will be recognized that an elastomeric mesh seat, which often must bear the entire weight of the seat occupant, will be required to provide far greater support than an elastomeric mesh back of the same seat. The filaments of the elastomeric mesh employed for seat bottoms normally must be quite thick compared to those of the seat back. For example, the monofilaments for seat backs are commonly in the range of 0.2 to 0.3 mm while those of seat bottoms are commonly in the range of 0.7 mm. Accordingly, designers seeking to exploit breathable mesh for seat bottoms have found it necessary to use an entirely different material for the seat bottom as compared to the seat back.

The increased thickness of the seat bottom material requires added cost while not contributing to any enhanced comfort. Indeed, thick monofilament elastomeric mesh can be even more disadvantageous since it can "chew" on clothing even faster than its thinner counterpart.

Designers may seek to mix different mesh materials—a lighter filament for the seat back and a heavier material for the seat bottom. However, obtaining matching textures, colors, and appearances can be difficult or impossible. Of course, it is possible to add one or more supportive cushioning underlayers, but the addition of supportive cushioning in direct contact with the elastomeric material defeats the purpose of mesh for its breathability and sleek appearance.

With a knowledge of the foregoing, the present inventor has discovered that it would be advantageous to provide supplemental pelvic support in elastomeric material applications so that the advantageous characteristics of elastomeric mesh fabric can be exploited without the disadvantages summarized above. The present inventor has further appreciated that it would be advantageous to provide further pelvic positioning support to seat occupants to facilitate sound ergonomic positioning in mobile task chair and other seating applications.

SUMMARY OF THE INVENTION

Accordingly, the present invention is founded on the basic object of providing a pelvic support for elastomeric seat bottom applications.

A further object of embodiments of the invention is to provide a pelvic support that permits the use of lighter gauge elastomeric materials in relation to seat bottoms to reduce cost, improve performance, and permit more convenient material matching with other seating components, including seat backs.

In certain embodiments, another object of the invention is to provide consistent pelvic support and positioning, including during movement of a seat occupant, to facilitate sound ergonomic positioning in mobile task chair and other seating applications.

These and further objects and advantages of the present invention will become obvious not only to one who reviews the present specification and drawings but also to those who have an opportunity to experience an embodiment of a seat employing the pelvic support disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the objects of the invention, one embodiment of the seat with pelvic support is founded on a seat bottom with a framework with a central area defined by an anterior portion, a posterior portion, and left and right portions. A panel of elastomeric material is retained under an initial tension spanning the framework for providing initial support to a seat occupant, and at least one resiliently deflectable pelvic support structure is retained in spaced relation from the panel of elastomeric material. The at least one resiliently deflectable pelvic support structure thus provides supplemental support to the seat occupant when the panel of elastomeric material is deflected to cause the panel of elastomeric material to contact the at least one resiliently deflectable pelvic support structure.

The resiliently deflectable pelvic support structure can comprise, for example, at least one resiliently deflectable finger retained by the framework. For instance, at least one resiliently deflectable finger can project to within a left portion of the central area of the framework, and at least one resiliently deflectable finger can project to within a right portion of the central area of the framework. In certain embodiments, plural resiliently deflectable fingers project to within the left portion of the central area of the framework and plural resiliently deflectable fingers project to within the right portion of the central area of the framework. It is contemplated that the seat bottom can include a longitudinally disposed central support member fixed in relation to the framework, and the resiliently deflectable fingers can project laterally outboard from the central support member. Alternatively, the resiliently deflectable fingers can project inboard from the framework.

The plural resiliently deflectable fingers can be considered have deflection resistances. At least some of the plural resiliently deflectable fingers can have different deflection resistances. This can be accomplished, for example, by the fingers having different lengths or other characteristics.

In a further refinement of the invention, the resiliently deflectable pelvic support structure can further include a pelvic support member retained by the at least one resiliently deflectable finger. Where there are plural resiliently deflectable fingers retained by the framework, a pelvic support member can be retained by each resiliently deflectable finger, such as in the form of a paddle-shaped tip. Alternatively, plural resiliently deflectable fingers can cooperate to retain the pelvic support member. Still further, there can be left and right pelvic support members, and plural resiliently deflectable fingers can cooperate to retain each pelvic support member. In any such embodiment, resiliently compressible connector joints can be interposed between the pelvic support member and the at least one resiliently deflectable finger.

In still other embodiments, there can be plural resiliently deflectable pelvic support structures with each resiliently deflectable pelvic support structure comprising an arch. Under such constructions, the arches project can inboard from the framework.

A rigidifying member, such as a contoured member of spring steel, can be secured to the framework. The rigidifying member can be U-shaped with a rear leg fixed to the posterior portion of the framework, a left leg fixed to the left portion of the framework, and a right leg fixed to the right portion of the framework. With that, rigidified lateral and rear portions of the framework can be established. Still further, the rear portion and at least the posterior portions of the left and right portions of the framework can be substantially rigid while the front portion of the framework is relatively flexible thereby to provide stable support to the seat occupant with anterior flexibility for comfort and ergonomic performance.

Embodiments of the invention can additionally incorporate a peripheral framework of resiliently compressible foam retained on the framework. The peripheral framework of resiliently compressible foam can have an outer portion of relatively hard foam and an inner portion of relatively soft foam such that the inner and outer portions cooperate to establish a cradle for a seated occupant.

The seat with pelvic support can have a seat back with a back frame and a panel of elastomeric material retained spanning the back frame. A support and positioning member can be retained in a fixed angular orientation relative to the seat bottom posterior to the panel of elastomeric material. To facilitate the fixed positioning, the seat back can have a base plate disposed at a fixed angle in relation to the back frame, and the base plate can be fixed to the seat bottom. Still further, the back frame can have a flexible upper portion and a rigid lower portion. A left rigidifying leg can be fixed to a lower and left leg of the back frame, and a right rigidifying leg can be fixed to the lower and right leg of the back frame. The support and positioning member can then be retained by the left and right rigidifying legs in a stable and fixed position.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

Figure 1:
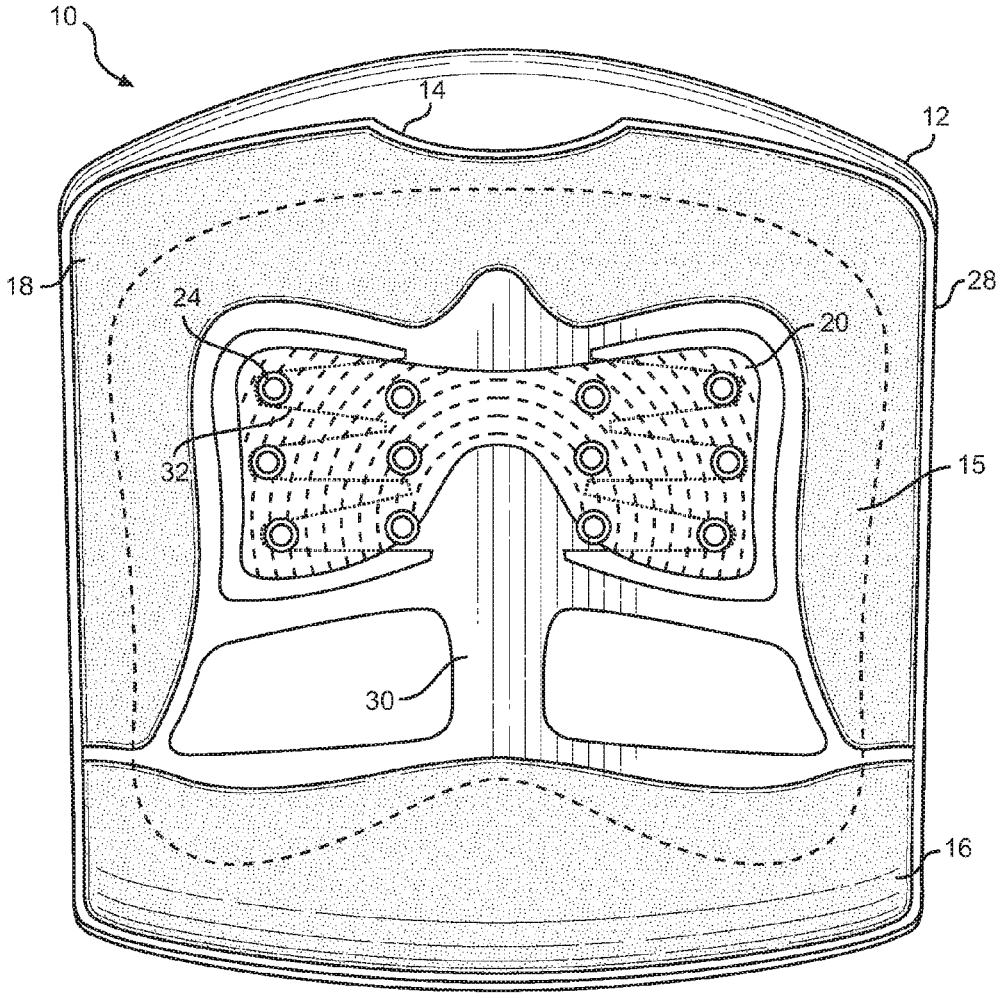
FIG. 1 is a top plan view of a seat bottom with a pelvic support as disclosed herein.
Figure 2:
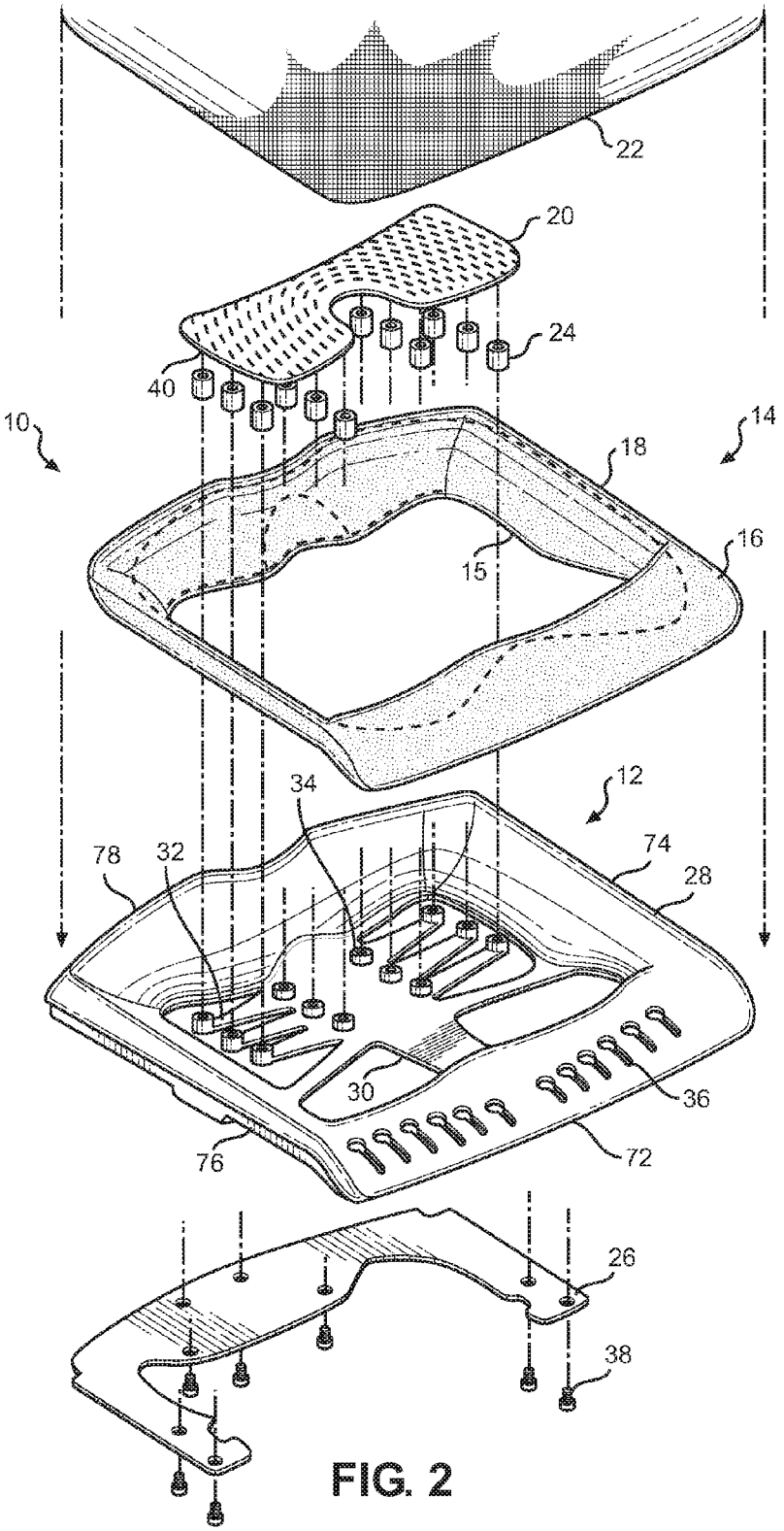
FIG. 2 is an exploded perspective view of a seat bottom with pelvic support according to the invention.

Any notes and details that may be included in the drawings are incorporated herein by reference but should not be interpreted as limiting the scope of protection of the invention in any manner.

DISCLOSURE OF EXEMPLARY EMBODIMENTS

The seat with pelvic support disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Therefore, before any particular embodiment of the invention is explained in detail, it must be made clear that the following details of construction and illustrations of inventive concepts are mere examples of the many possible manifestations of the invention.

Turning more particularly to the drawings, a seat bottom with a pelvic support according to the invention is indicated generally at 10 in FIGS. 1 through 7. As shown, the seat bottom 10 has a pelvic support 20 for being disposed in initially spaced relation relative to a panel 22 of elastomeric material, such as elastomeric mesh, that is retained under an initial tension spanning a peripheral framework 28. By providing supplemental support in the form of a centralized pelvic support 20, embodiments of the invention can use lower thickness mesh or other elastomeric material while still providing adequate support to the seat occupant. With this, material expenditures are reduced, and matching fabrics between seat bottoms and other chair components, such as seat backs, becomes far more convenient. Costs are reduced while comfort and performance are improved.

The pelvic support 20 and the overall seat bottom 10 can pursue many variations within the scope of the invention. As shown perhaps most clearly in FIG. 2, embodiments are contemplated wherein a main seat frame 12 of substantially rigid material, such as plastic, has a plurality of flexible or otherwise deflectable fingers 32 retained by the seat frame 12. In this example, the frame 12 has a peripheral framework 28 that establishes a generally open central portion and a continuous or substantially continuous periphery for retaining the panel 22 of elastomeric material.

A longitudinally disposed central support member 30 traverses from a mid-portion of a front leg 72 of the peripheral framework 28 across the open central portion to a mid-portion of a rear leg 78 of the peripheral framework 28. The front leg 72 of the peripheral framework 28 has a plurality of flexion relief formations 36, which in this case comprise keyhole shaped openings, disposed therein in longitudinal alignment with the seat bottom 10. The rear leg 78 and at least the posterior portions of the left and right legs 74 and 76 of the peripheral framework 28 are substantially rigid.

A plurality of fingers 32 project laterally outboard from the central support member 30 to the left side thereof, and a corresponding plurality of fingers 32 project laterally outboard from the central support member 30 to the right side thereof. As illustrated, the peripheral framework 28, the central support member 30, and the fingers 32 can be integrally formed, as by molding, but this need not necessarily be the case. The fingers 32 are resiliently flexible 32 and are disposed to align with the pelvis of a seat occupant (not shown in these drawings). The fingers 32 can be identical or variable in flexible support as described further below.

Each finger 32 retains a lug 34 at the distal end thereof. As shown, lugs 34 can additionally be disposed at or adjacent to the proximal ends of the fingers 32. Some lugs 34 may be disposed, whether partially or completely, on the central member 30. Each lug 34 engages and retains a connector joint 24. The connector joints 24 can be resiliently compressible, such as by being formed from a rubber, foam, or other resiliently compressible material.

Through the lugs 34 and the connector joints 24, the resilient fingers 32 and the central member 30 retain at least one resiliently deflectable pelvic support 20. In this example, the pelvic support 20 is unitary and comprises a flexible panel of material that can be shaped and contoured to correspond to the shape and contour of a seated human posterior. To that end, the pelvic support 20 can have cupped left and right wings and a central portion with an anterior U-shaped, open inlet. The pelvic support 20 can be breathable, whether based on material selection, by having plural through-holes or perforations therein as illustrated, or some combination or alternative thereto. As FIG. 3 shows perhaps most clearly, the pelvic support 20 can have lugs 40 disposed on the lower surface thereof corresponding to the relative positions of the lugs 34 on the resilient fingers 32 and the central member 30 for positively engaging the connector joints 24.

Figure 3:
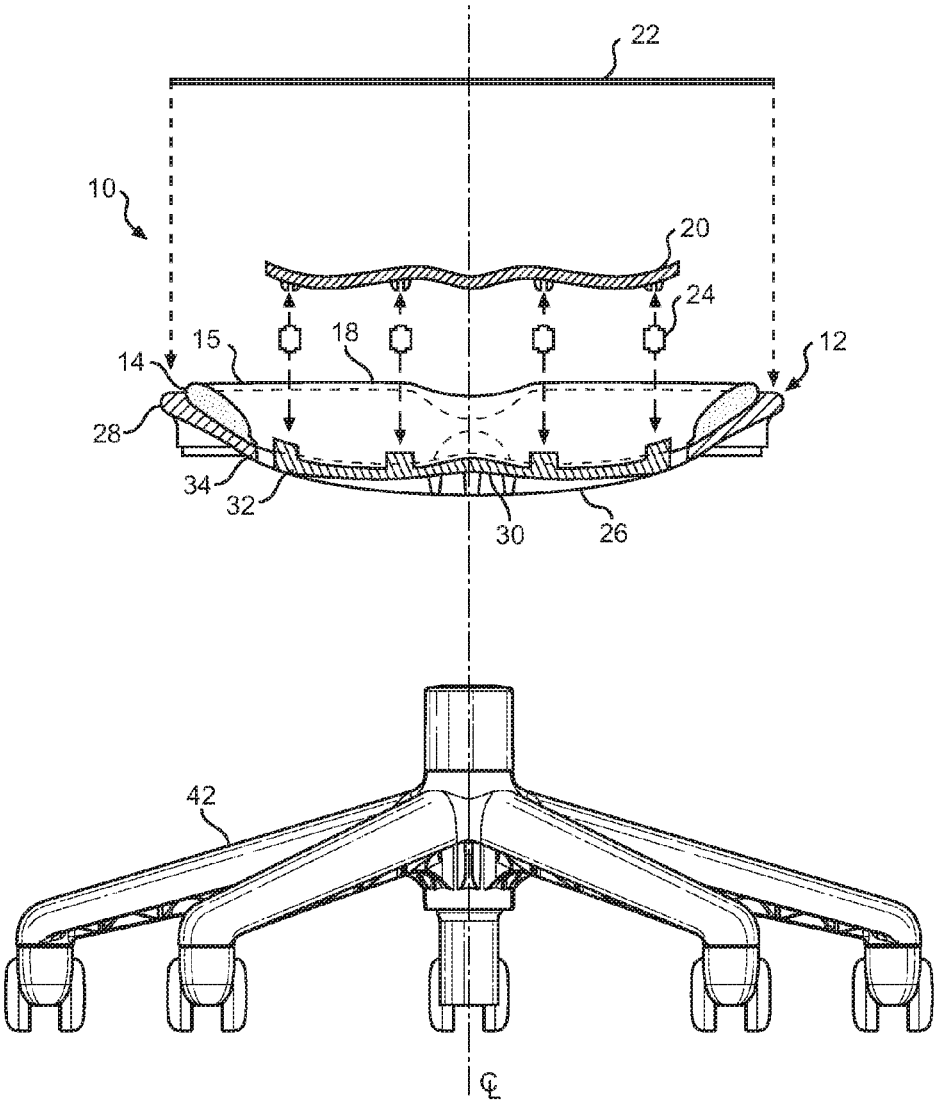
FIG. 3 is a partially exploded, partially cross-sectioned view in front elevation of a seat bottom with pelvic support.

While many constructions for engaging the connector joints 24 with the lugs 34 and 40 might be obvious to one skilled in the art after reviewing this disclosure, the present embodiment as depicted in FIG. 3 exploits a mating connection between the connector joints 24 and the lugs 34 and 40. The connector joints 24 may be characterized as abbreviated columns with narrowed tips. The lugs 34 and 40 can comprise raised rings or tubes for receiving the tips of the connector joints 24. The lugs 34 and 40 and the column portions of the connector joints 24 may be approximately equal in outer diameter such that the unified lugs 34 and 40 and connector joints 24 together form a column shape when connected.

Figure 4:
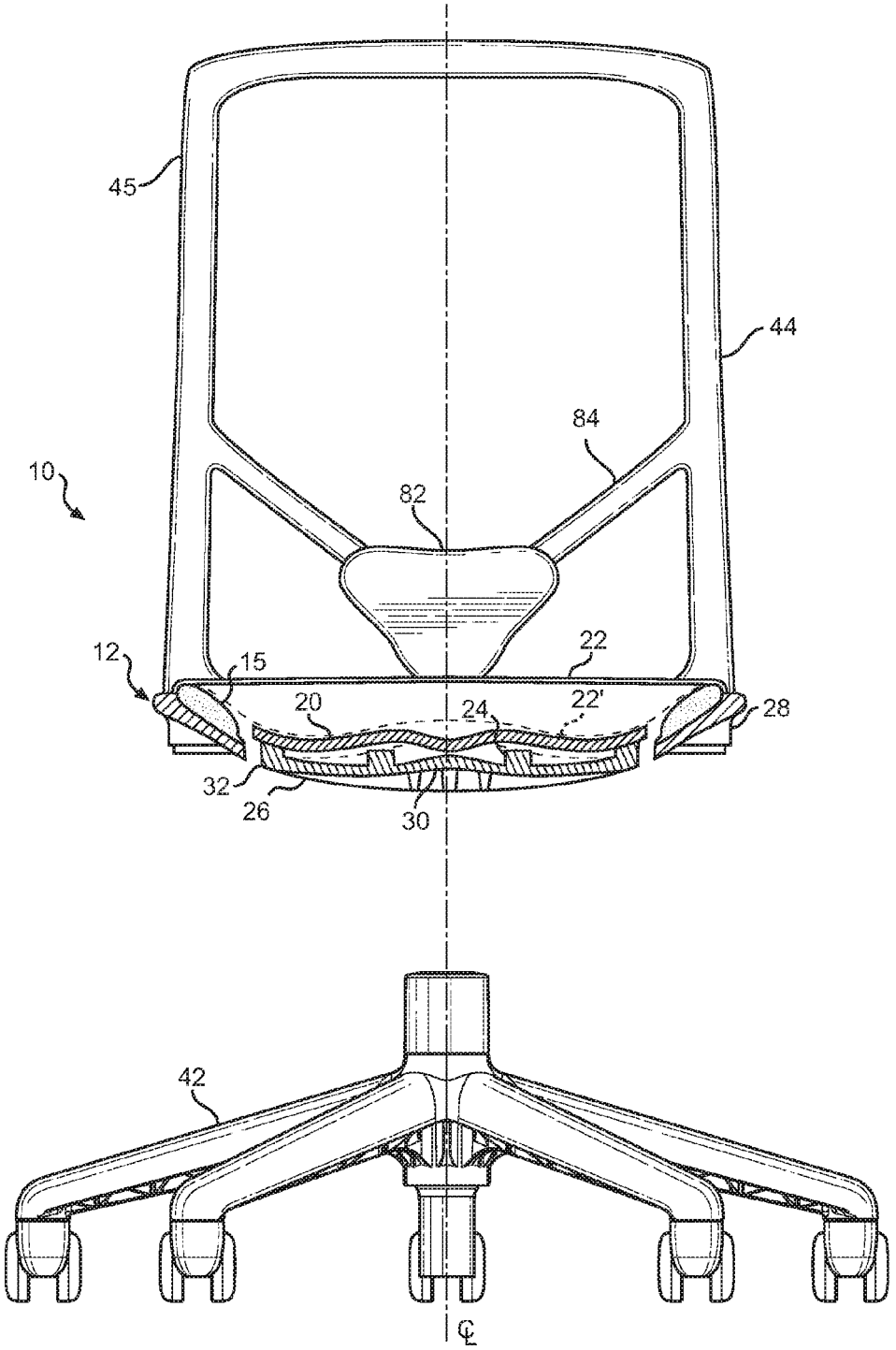
FIG. 4 is a cross-sectioned elevation view of the seat bottom with pelvic support pursuant to the invention.

As illustrated in FIG. 4, the seat frame 12 and the retained components are formed such that the panel of elastomeric material 22 is maintained when the seat bottom 10 is not occupied and the elastomeric material 22 is under an initial tension in spaced relation from the pelvic support 20 by a deflection spacing. When the elastomeric material 22 disposed under a load, such as when a seat occupant is seated in the seat bottom 10, the elastomeric material can deflect to the position and configuration illustrated at 22' where the elastomeric material 22' makes contact with the pelvic support 20.

With that, by and through the pelvic support 20, the resilient fingers 32 and the central member 30 cooperate with the elastomeric material 22 to provide contoured support to a seat occupant, and the elastomeric material 22 need not support the entire weight of the seat occupant. The elastomeric material 22 acts as an initial support to a seat occupant with the pelvic support 20 cooperating with the elastomeric material 22 to provide resilient support to the seat occupant when the elastomeric material 22 is sufficiently deflected. The comfort and breathability of the elastomeric material 22 can thus be exploited without requiring the elastomeric material 22 to support the entire force applied by the seat occupant's pelvis.

The seat bottom 10 establishes rigid lateral and posterior portions with relatively flexible central and anterior support portions. A plurality of aspects of the invention contribute in this regard. In one aspect, the rear leg 78 and at least the posterior portions of the left and right legs 74 and 76 of the peripheral framework 28 are substantially rigid while the front leg 72 is relatively flexible, which can be accomplished by the flexion relief formations 36 and, additionally or alternatively, by a difference in material thickness or material selection in relation to the left, right, and rear legs 74, 76, and 78.

The rigidity of the lateral and rear portions or zones and the relatively flexible central and anterior zones is further achieved by securing a rear and lateral rigidifying member 26 to the peripheral framework 28. The rigidifying member 26 can be formed from a metal, such as steel spring material, and the peripheral framework 28 can be formed from a polymeric material, such as a thermoplastic polymer, preferably glass filled nylon. The rigidifying member 26 can overlap with the rear leg 78 of the peripheral framework 28 and posterior portions of the left and right legs 74 and 76 such that it has a rear leg and truncated left and right legs. The rigidifying member 26 is thus generally U-shaped thereby leaving open anterior and interior portions to permit the desired flexibility of the anterior and interior portions of the framework 28. In this depicted embodiment, the rigidifying member 26 can be formed with rigidifying shaping and contouring corresponding to the shape and contour of the overlapping portions of the peripheral framework 28. The rigidifying member 26 can be secured to the left, right, and rear legs 74, 76, and 78 of the peripheral framework 28 by mechanical fasteners 38 or in any other effective manner.

Figure 5:
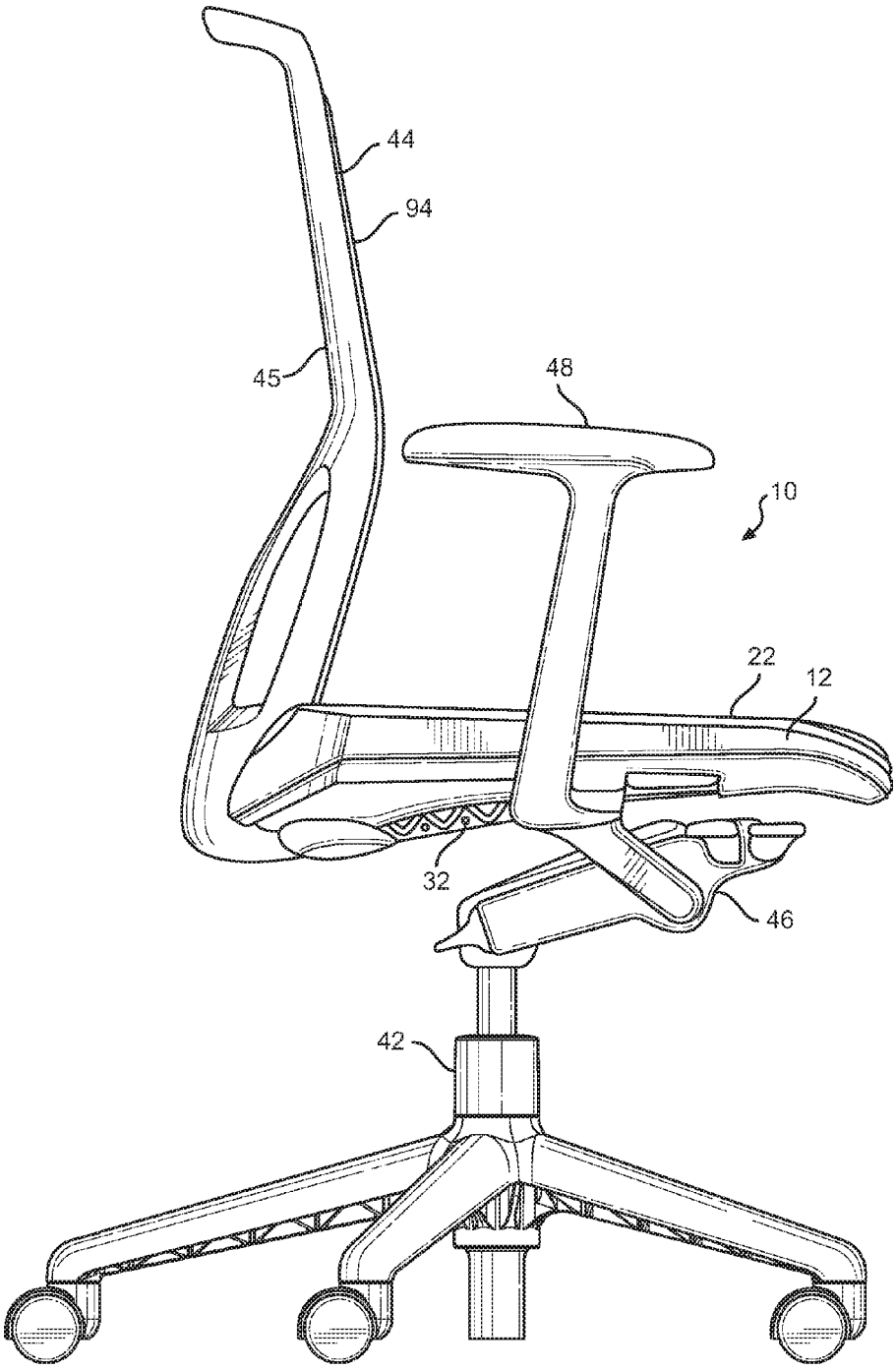
FIG. 5 is a view in side elevation of a seat with a seat bottom with pelvic support as disclosed herein.
Figure 6:
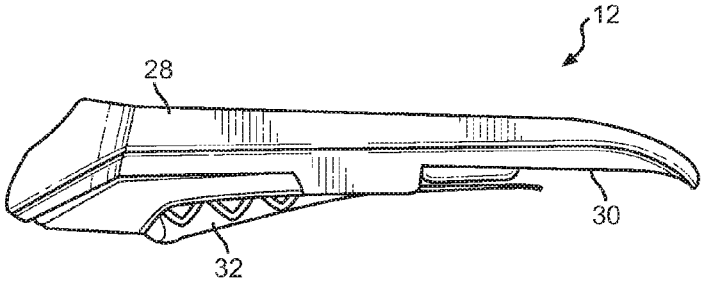
FIG. 6 is a view in side elevation of a seat frame with pelvic support as taught herein.
Figure 7:
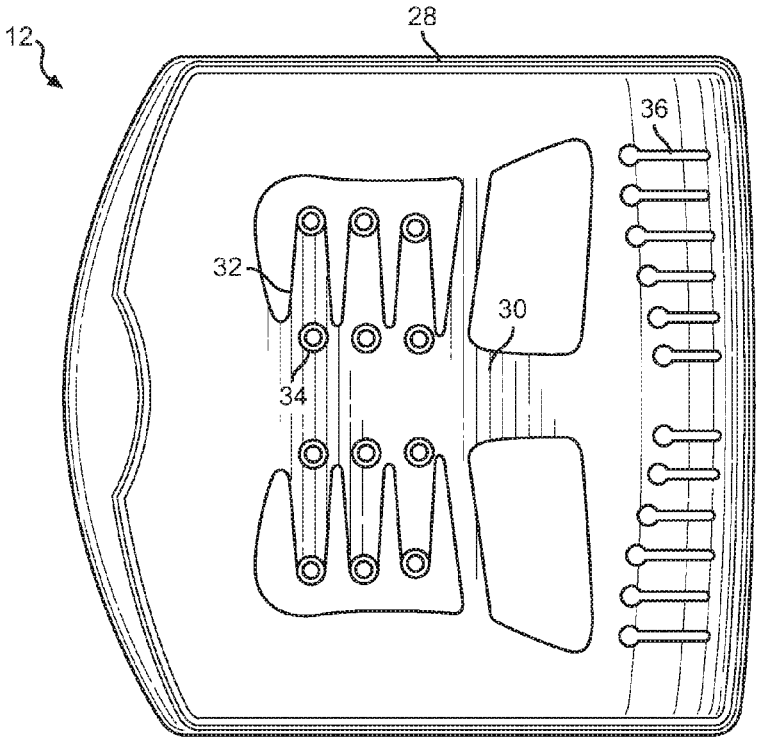
FIG. 7 is a top plan view of the seat frame of FIG. 6.

As is illustrated in FIG. 5, the anterior ends of the left and right legs of the rigidifying member 26 can be employed for coupling to a seat support mechanism 46 and, through the support mechanism 46, a chair base 42. Moreover, a chair back 44 can be retained, such as by being fixed to the seat bottom 10 by being secured to the rigidifying member 26, and a panel 94 of elastomeric material can be disposed under an initial tension spanning the frame 45 of the chair back 44. Seat arms 48, which can be fixed or adjustable in height, optionally can be retained, such as by being fixed to the support mechanism 46, the rigidifying member 26, a combination thereof, or to some other chair component.

Still further, control over the localized rigidity of the seat bottom 10 is achieved by use of a peripheral framework 14 of resiliently compressible foam with localized, intra-layer variations in compression characteristics, such as through variations in density. The shapes and locations of the variations in compression characteristics can vary depending on, among other things, manufacturing goals, anticipated user preferences, and other characteristics. As best seen perhaps in FIG. 2, the peripheral foam framework 14 in this example of the invention has a contoured inner portion 15 and a contoured outer portion 16. The portions 15 and 16 have different compressibilities but are joined, such as by bonding, integral formation, interlocking, or in any other manner or combination thereof, in juxtaposition within a single layer or level. In one practice of the invention, the inner portion 15 can be softer and more easily compressed than the outer portion 16. The outer portion 16 establishes a posterior U-shape with a relatively hard rear portion and relatively hard left and right legs and, potentially, a facing, anterior leg. With that, the inner and outer portions 15 and 16 cooperate to establish what is effectively a cradling of a seated occupant.

Within the scope of the invention, the portions 15 and 16 may overlap one another, whether by sloped, complementary faces, by a tongue-and-groove relationship, or by some other overlapping configuration. Also, while two distinct portions 15 and 16 are shown, it will be understood that more and differently configured portions may be exploited.

Figure 8:
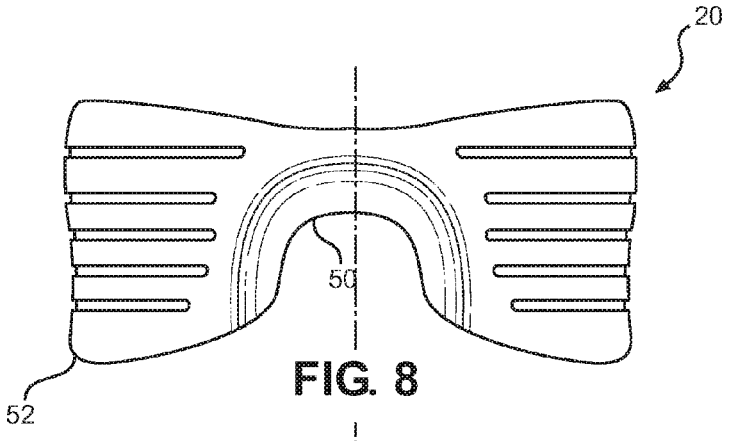
FIGS. 8 through 10 are top plan view of alternative embodiments of the pelvic support for a seat bottom.
Figure 9A:
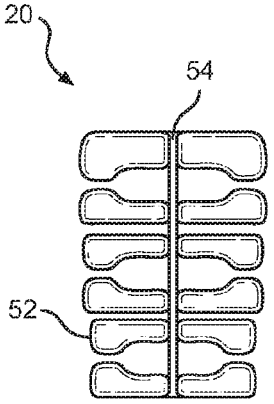
Figure 9B:
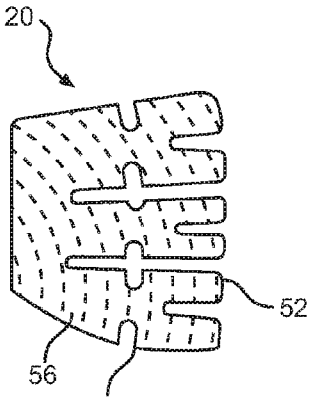
Figure 10:
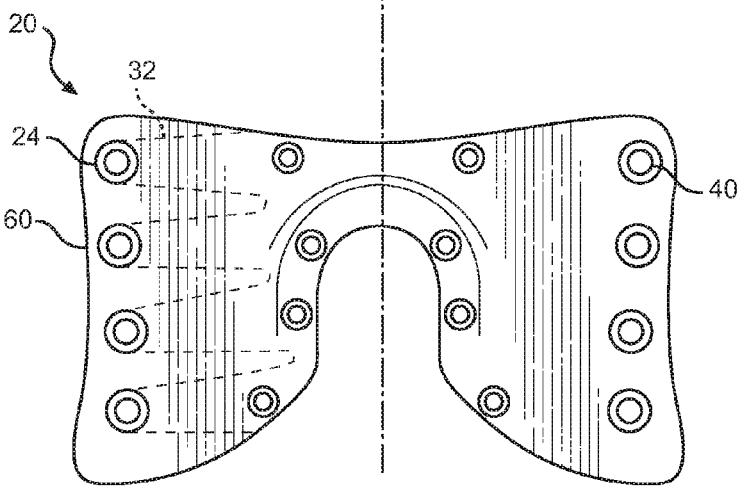

As shown in FIGS. 8 through 18, the pelvic support 20 can pursue alternative constructions within the scope of the invention. For example, as FIG. 8 shows, the pelvic support 20 can have a plurality of resilient ribs 52 that project from a central support 50 and that can be coupled by webbing therebetween. Embodiments are possible as in FIG. 10, where the pelvic support 20 is provided by flexible right and left support members 60 that are supported by resilient fingers 32 with connector joints 24 interposed therebetween. In certain embodiments, as FIG. 9A suggests, flexion characteristics can be achieved by the pelvic support 20 having left and right portions, each with a central spine 54 and a plurality of flexible fingers 52 that project laterally therefrom. As seen in FIG. 9B, desired flexion characteristics can be realized by perforations 56 in left and right pelvic supports 20 and by deviations in the shape and thickness of the pelvic support, such as in fingers 52 or ribs retained by the support and spaced inlets within the pelvic support 20 and the fingers 52.

Figure 11:
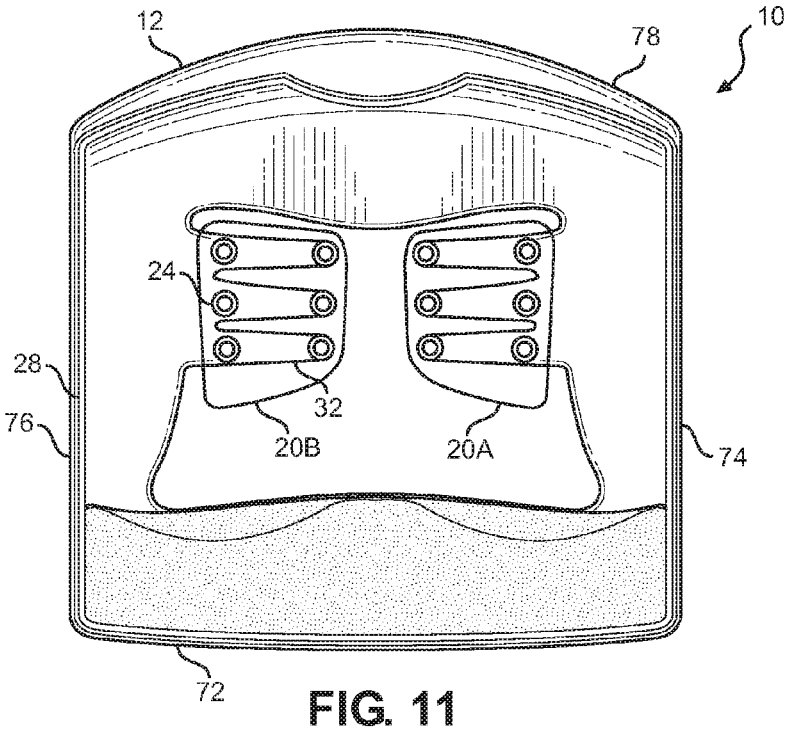
FIGS. 11 through 13 are top plan views of alternative seat frames with pelvic supports embodying the invention.
Figure 12:
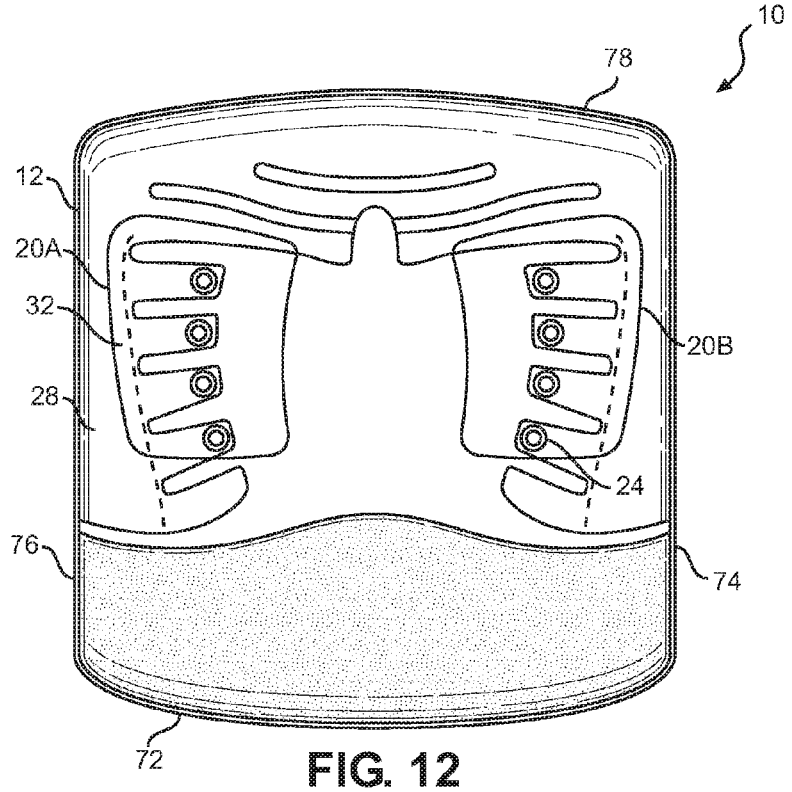
Figure 13:
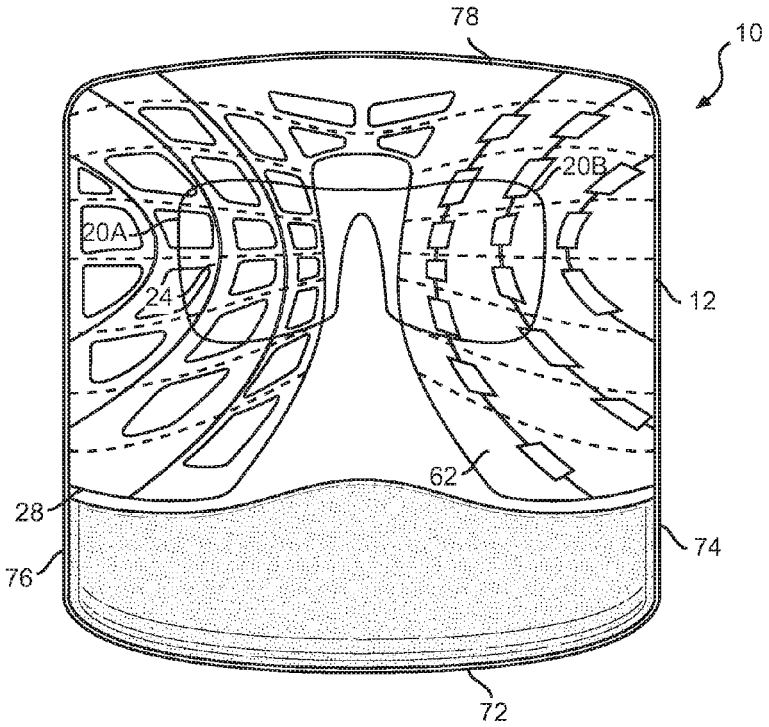

It will be understood that the resilient retention of the pelvic support 20 by the framework 28 could be achieved under other configurations. For example, as FIGS. 11 and 12 show, resilient pelvic support fingers 32 can project inboard from the left and right 74 and 76 legs of the peripheral framework 28. There, left and right pelvic supports 20A and 20B are retained by the fingers 32 projecting from the left and right legs 74 and 76. The left and right pelvic supports 20A and 20B can thus be disposed in opposition to left and rights sides of a longitudinal centerline of the seat bottom 10. Still further, as illustrated by FIG. 13, seat bottoms 10 can have flexible central portions, such as by the formation of plural flexible arches 62 that project inboard from the left and right legs 74 and 76 of the seat framework 28. The flexibility of the arches 62 can be further manipulated in any effective manner, including by interposing apertures, by material selection, or by some other mechanism or combination thereof.

Figure 14:
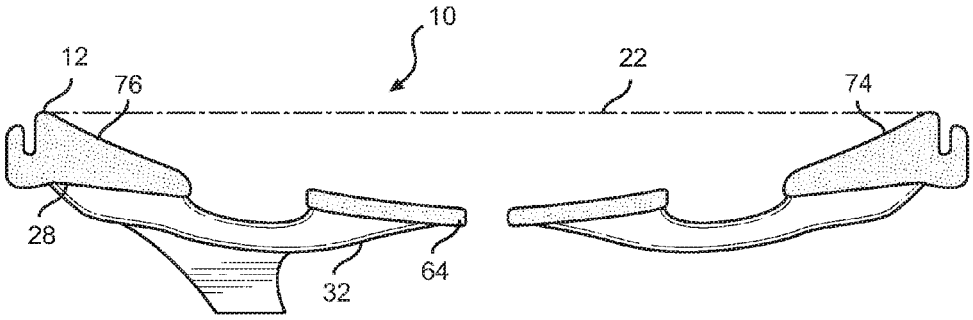
FIG. 14 is a sectioned view in front elevation of a seat frame with pelvic support as taught herein.

As shown in FIGS. 14 through 18, it is further contemplated that a separate pelvic support 20 can be foregone with secondary pelvic support being provided directly by one or more flexible members, such as fingers 32. In FIG. 14, for example, plural fingers 32 project inboard from the left and right legs 74 and 76. Each finger 32 has a widened paddle tip 64 for comfortable applying supportive force to a seat occupant once the elastomeric material 22 has been sufficiently deflected. With this, support can be provided to a seat occupant by the elastomeric material 22 and multiple support fingers 32 simultaneously.

Figure 15:
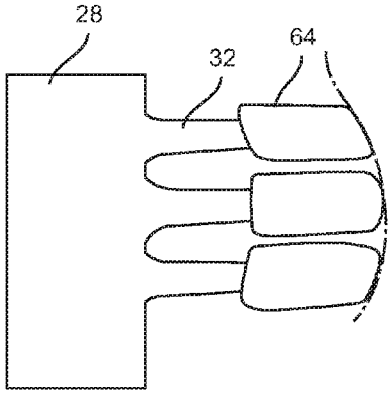
FIGS. 15 and 16 are top plan views of pelvic support fingers according to the invention.
Figure 16:
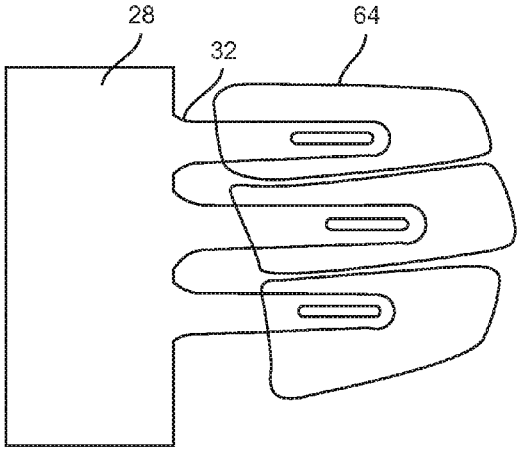

In any embodiment, hyper-localized variations in supportive force can be realized by variations in the shape, size, configuration, material, or other characteristic of the several fingers 32. For example, as FIG. 15 shows, fingers 32 can vary in length thereby to operate over different average moment arms and to exhibit different deflection resistances. Moreover, the paddle tips 64 of the fingers 32 can vary in width, length, and shape to apply supporting force over varied shapes and areas as seen, for example, in FIG. 16.

Figure 17:
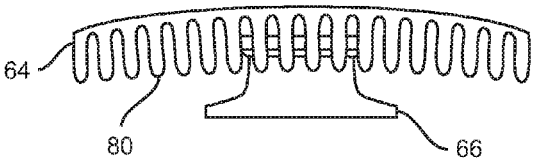
FIG. 17 is a cross-sectioned view in side elevation depicting flexion characteristics of a pelvic support pursuant to the invention.
Figure 18:
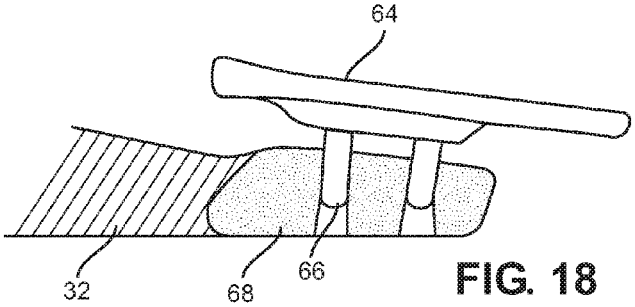
FIG. 18 is a cross-sectioned view in front elevation of the pelvic support fingers of FIG. 16.
Figure 19:
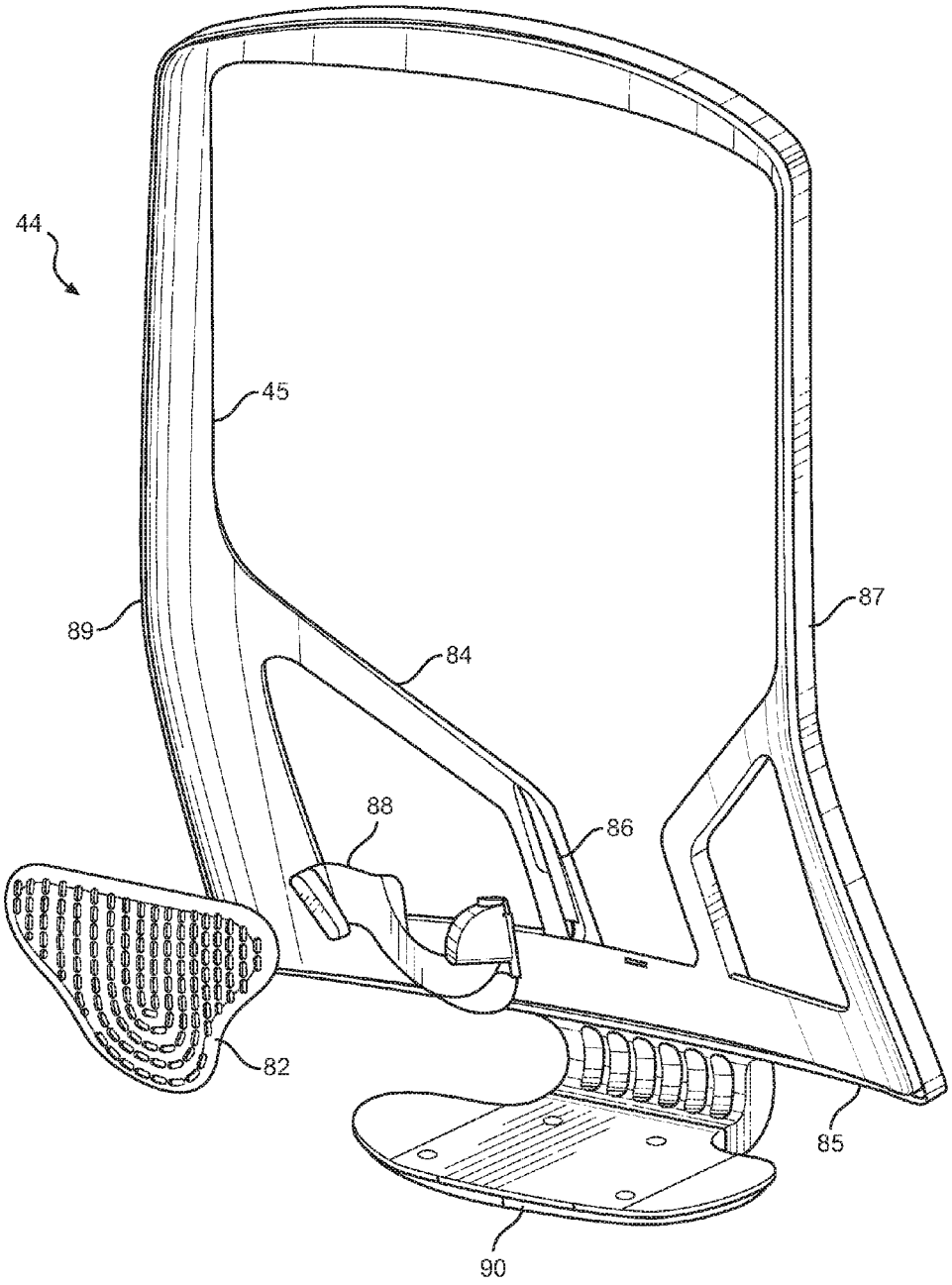
FIG. 19 is an exploded perspective view of a seat back structure with a pelvic support and positioning member as taught herein.

As illustrated in FIG. 18, the paddle tips 64 could be removable and replaceable in relation to the fingers 32. With that, the support characteristics of the paddle tips 64 can be varied by employing differently configured paddle tips 64. While numerous arrangements for providing removable and replaceable paddle tips 64 are possible within the scope of the invention, the present embodiment as depicted in FIG. 18 can have base projections 66 that project from the lower portion thereof that are received into corresponding apertures 68 in the distal portion of the fingers 32. Under this construction, paddle tips 64 can be removed, replaced, and exchanged as might be desirable to adjust the supportive force applied thereby in one or more characteristics. The paddle tips 64 can be pliant for comfort and conformability. As shown in FIG. 17, the paddle tips 64 can have a smooth upper surface for making contact with the elastomeric material 22 and a series of aligned fins 80 projecting from the underside thereof for limiting deflection to a predetermined curvature.

As contemplated herein, differentiated flex zones can be created based on, among other things, expected load distributions on the seat bottom 10. For example, fingers 32 or other resiliently deflectable members can be varied in resilience, number, and location. Moreover, differently shaped tip portions of the fingers 32 or other resiliently deflectable members can be employed to suit design and user characteristics and goals.

Figure 20:
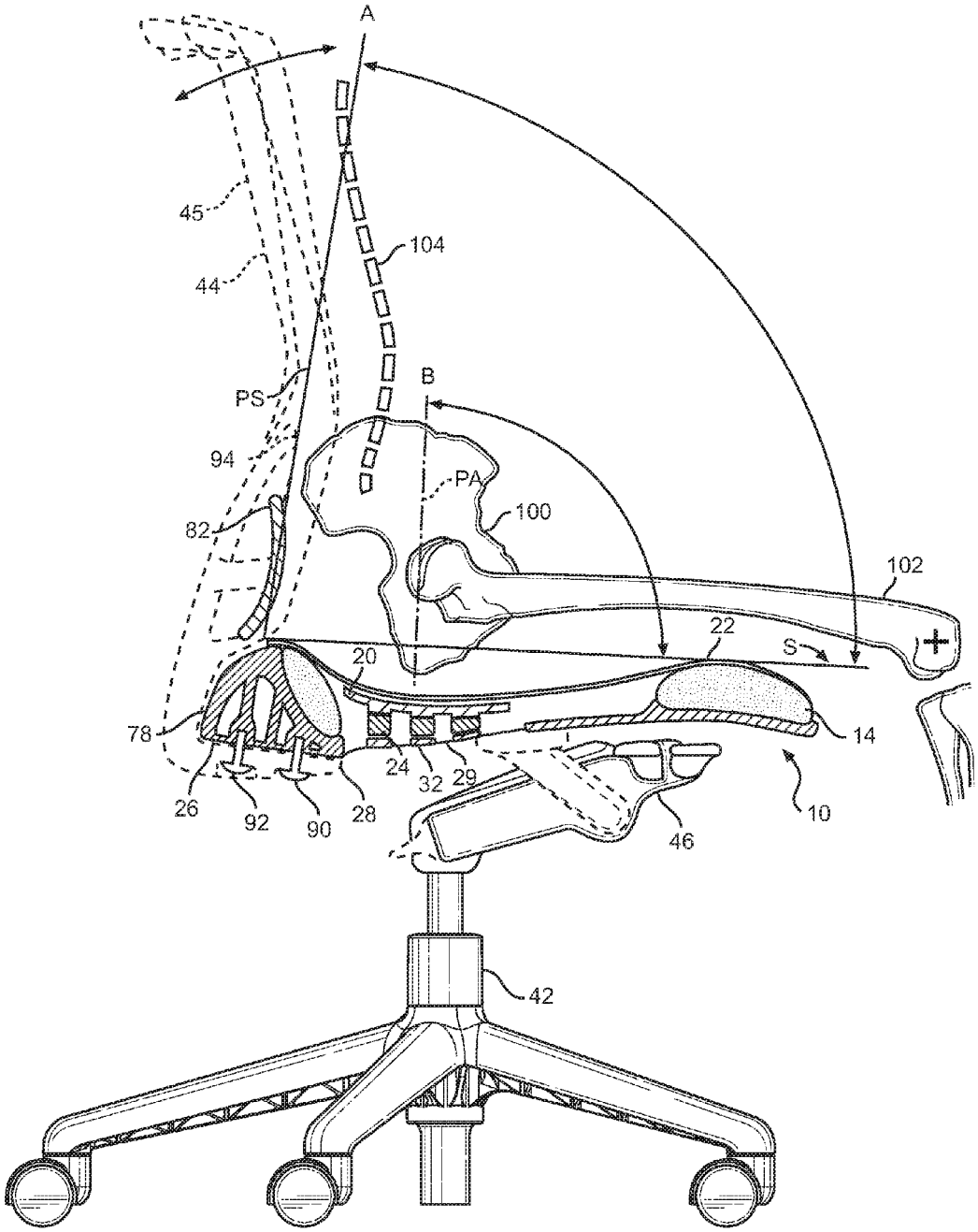
FIG. 20 is a partially sectioned view in side elevation of a mobile chair with a pelvic support and positioning member according to the invention.
Figure 21:
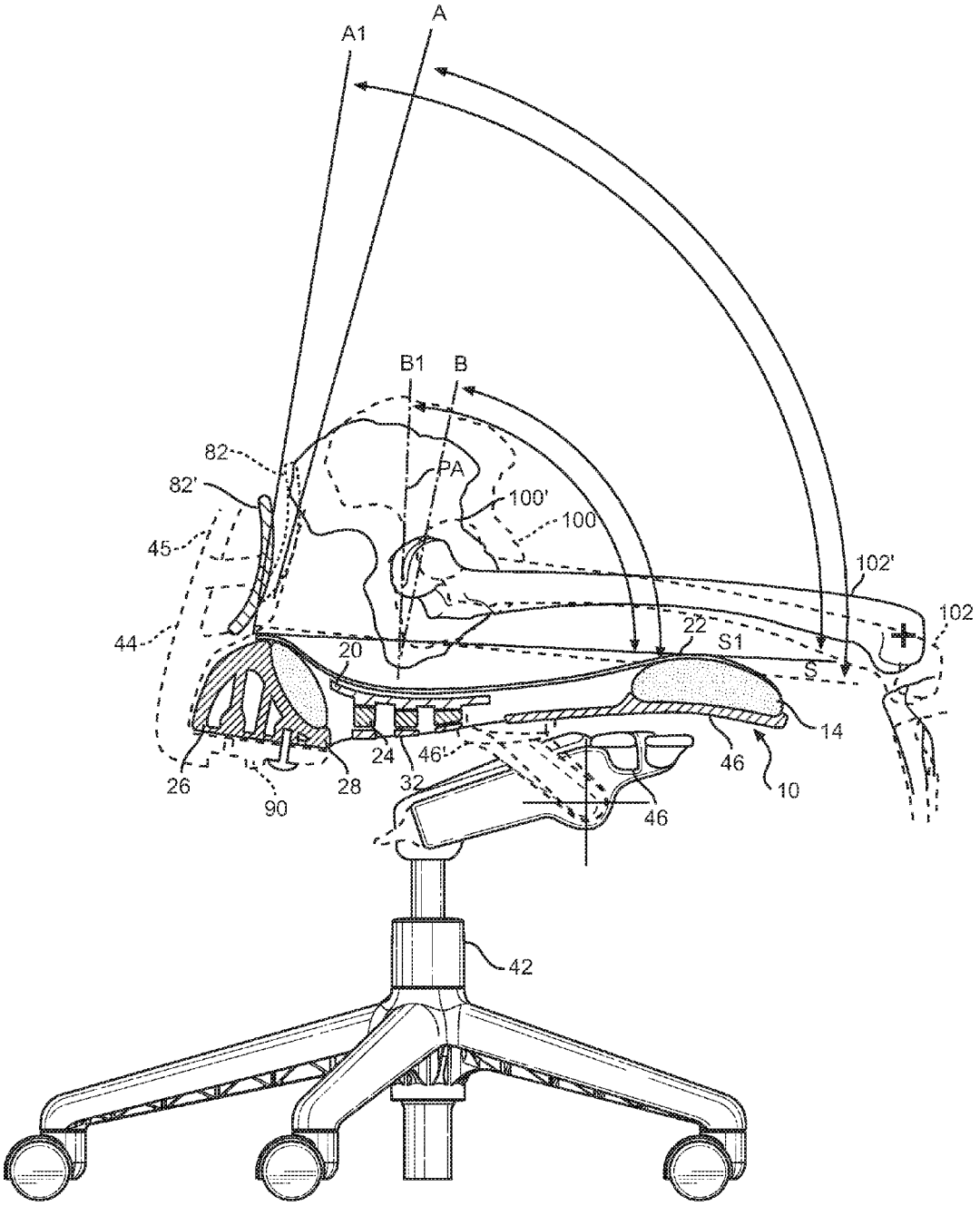
FIG. 21 is a further partially sectioned view in side elevation of a mobile chair with a pelvic support and positioning member.
Figure 22:
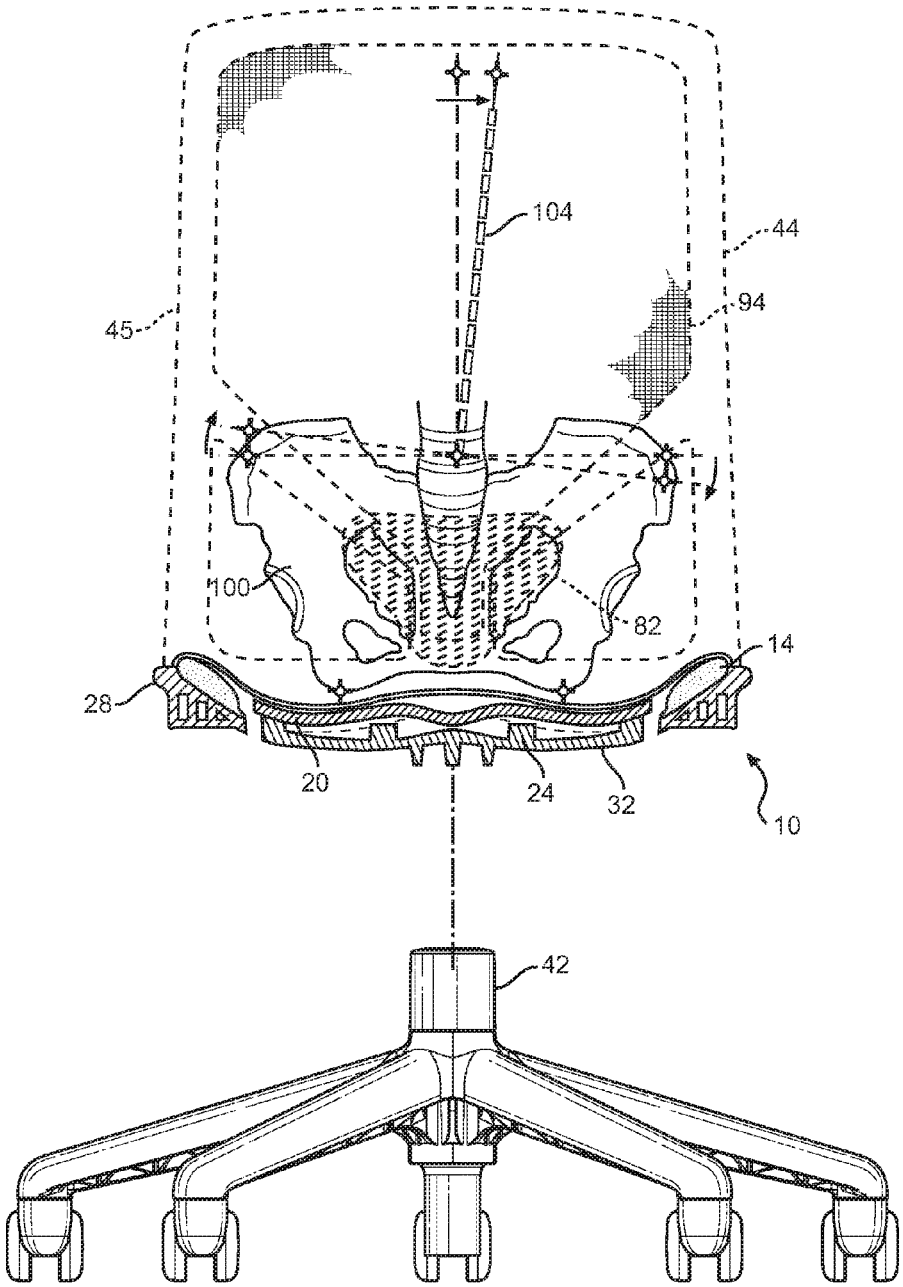
FIG. 22 is a partially sectioned view in rear elevation of a mobile chair with a pelvic support and positioning member pursuant to the invention.

As shown in FIG. 5 and further in FIGS. 19 through 22, further pelvic support and positioning can be provided by a support and positioning member 82 retained by the frame 45 of the seat back 44 posterior to the panel 94 of elastomeric material as shown, for example, in FIGS. 20 and 22. The support and positioning member 82, which can be multidirectionally flexible, is preferably maintained in a fixed angular orientation relative to the seat bottom 10. While the member 82 may itself be flexible for the comfort of the seat occupant, the fixed angular position of the support and positioning member 82 is achieved by a fixed, non-pivoting connection of the seat back 44 to the seat bottom 10 in conjunction with a substantial rigidity of the lower portion of the seat back 44.

The fixed connection of the seat back 44 to the seat bottom 10 could be accomplished in a number of ways within the scope of the invention. In the present embodiment, the seat back 44 has a base plate 90 disposed at a fixed angle in relation to the back frame 45, such as by being formed integrally therewith in a molding process. The base plate 90 and thus the seat back 44 in general are fixed to the seat bottom 10 by mechanical fasteners 92 passed through the base plate 90 and into the rigid rear leg 78 of the seat frame 28 as FIGS. 20 and 21 show.

As illustrated, for example, in FIG. 22, the back frame 45 has a flexible upper portion and a rigid lower portion. The support and positioning member 82 is retained in a fixed position by the rigid lower portion of the seat back frame 45 so that a substantially fixed pelvic support angle A is established between a line of pelvic support PS established by the member 82 and a support surface S of the seat bottom 10. As taught herein, the angle A is substantially fixed.

The depicted embodiment achieves the fixed positioning of the member 82 through left and right vertical members 86 that fixedly project from a rigid base leg 85 of the seat back 44 and lateral members 84 fixed to the upper ends of the vertical members 86 to be fixed to the left and right upright legs 87 and 89 of the frame 45. A rigid retention system is thus established with the vertical members 86 acting as receivers for a bracket 88 that in turn retains the support and positioning member 82. While this could be accomplished in multiple ways, the illustrated vertical members 86 have receiving channels therein while the bracket 88 has aligned, outboard ridges for being slidably received by the channels. When the seat bottom 10 and seat back 44 are fully assembled as, for example, in FIGS. 20 through 22, the support and positioning member 82 is retained in a fixed position posterior to the panel 94 of elastomeric material.

With further reference to FIGS. 20 and 21, it will be seen that an angle B is established when a seat occupant is seated with his or her pelvis 100 supported by the surface S established by the panel 22 of elastomeric material and the pelvis 100 is supported and positioned by the support and positioning member 82. With the ergonomic positioning encouraged by the member 82 and its fixed positioning relative to the seat bottom 10, the person's pelvis 100 will be supported at a pelvic angle PA relative to the surface S to establish the angle B, and his or her spine 104 will assume a natural S-curve while the femurs 102 of his or her legs will rest comfortably on the relatively flexible central and anterior portions of the seat bottom 10.

When the pivoting mechanism 46 is pivoted, such as to the position indicated at 46' and the seat bottom 10 moves to the position suggested by 10', the pelvis 100 will move to the position indicated at 100' and the femurs 102 to a position indicated at 102'. The support and positioning member 82 will move with the seat bottom 10 to the position indicated at 82' such that the adjusted angle A1 will substantially match the original angle A, and the differences between the angles A and A1 will substantially match or be in correspondence with the differences between the angle B and the adjusted angle B1 between the pelvic angle PA and the seat surface S.

Accordingly, with the fixed support and positioning member 82, proper ergonomic positioning of the pelvis 100 and spine 104 will be maintained. Moreover, while the position of the member 82 remains unchanged to provide a substantially constant pelvic support angle 10, the flexibility of the central and anterior portions of the seat bottom 10 permits comfortable forward, rearward, and lateral tilting of the seat occupant. By the flexibility of the panel 22 of elastomeric material and the resilient fingers 32, the pelvis 100 and spine 104 of the seat occupant enjoy continued ergonomic support, including during a lateral tilting of the pelvis 100 and spine 104 as suggested in FIG. 22. As the pelvis 100 and spine 104 move, they continue to be cradled by the peripheral framework 14 of resiliently compressible foam with localized, intra-layer variations in compression characteristics. By a selective variance of the resilient support provided by the fingers 32 as described previously, hyper-localized control can be exercised over the resilient support provided to the pelvis 100 and the seat occupant in general.

With certain details and embodiments of the present invention for seats with pelvic support disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof

I claim as deserving the protection of Letters Patent:

1. A seat with pelvic support, the seat comprising:

a seat bottom with a framework with a central area defined by an anterior portion, a posterior portion, and left and right portions;

a panel of elastomeric material retained under an initial tension spanning the framework for providing initial support to a seat occupant; and at least one resiliently deflectable pelvic support structure retained in spaced relation from the panel of elastomeric material;

wherein the at least one resiliently deflectable pelvic support structure provides supplemental support to the seat occupant when the panel of elastomeric material is deflected to cause the panel of elastomeric material to contact the at least one resiliently deflectable pelvic support structure;

wherein the at least one resiliently deflectable pelvic support structure comprises a plurality of resiliently deflectable fingers retained by the framework for providing supplemental support to the seat occupant wherein the plurality of resiliently deflectable fingers have proximal portions retained by the framework, free distal ends, and deflection resistances and wherein at least some adjacent resiliently deflectable fingers have different deflection resistances.

2. The seat with pelvic support of claim 1 wherein at least some adjacent resiliently deflectable fingers have different lengths.

3. The seat with pelvic support of claim 1 further comprising a rigidifying member secured to the framework wherein the rigidifying member is U-shaped with a rear leg fixed to the posterior portion of the framework, a left leg fixed to the left portion of the framework, and a right leg fixed to the right portion of the framework whereby rigidified lateral and rear portions of the framework are established.

4. The seat with pelvic support of claim 1 further comprising a seat back with a back frame and a panel of elastomeric material retained spanning the back frame and further comprising a support and positioning member retained in a fixed angular orientation relative to the seat bottom.

5. The seat with pelvic support of claim 4 wherein the seat back has a base plate disposed at a fixed angle in relation to the back frame and wherein the base plate is fixed to the seat bottom.

6. The seat with pelvic support of claim 1 wherein the resiliently deflectable pelvic support structure further comprises at least one pelvic support member retained by the plurality of resiliently deflectable fingers wherein the at least one pelvic support member comprises a panel of material.

7. The seat with pelvic support of claim 6 wherein each of the plurality of resiliently deflectable fingers retains a pelvic support member and wherein each pelvic support member comprises a paddle-shaped tip.

8. The seat with pelvic support of claim 6 further comprising a plurality of resiliently compressible connector joints interposed between the pelvic support member and the plurality of resiliently deflectable fingers.

9. The seat with pelvic support of claim 6 wherein plural resiliently deflectable fingers cooperate to retain the pelvic support member.

10. The seat with pelvic support of claim 9 wherein there are left and right pelvic support members and wherein plural resiliently deflectable fingers cooperate to retain each pelvic support member.

11. A seat with pelvic support, the seat comprising:

a seat bottom with a framework with a central area defined by an anterior portion, a posterior portion, and left and right portions;

a panel of elastomeric material retained under an initial tension spanning the framework for providing initial support to a seat occupant;

at least one resiliently deflectable pelvic support structure retained in spaced relation from the panel of elastomeric material wherein the at least one resiliently deflectable pelvic support structure provides supplemental support to the seat occupant when the panel of elastomeric material is deflected to cause the panel of elastomeric material to contact the at least one resiliently deflectable pelvic support structure; and a rigidifying member secured to the framework wherein the rigidifying member is U-shaped with a rear leg fixed to the posterior portion of the framework, a left leg fixed to the left portion of the framework, and a right leg fixed to the right portion of the framework whereby rigidified lateral and rear portions of the framework are established wherein the rear portion and at least the posterior portions of the left and right portions of the framework are substantially rigid and the front portion of the framework is relatively flexible.

12. A seat with pelvic support, the seat comprising:

a seat bottom with a framework with a central area defined by an anterior portion, a posterior portion, and left and right portions;

a panel of elastomeric material retained under an initial tension spanning the framework for providing initial support to a seat occupant;

at least one resiliently deflectable pelvic support structure retained in spaced relation from the panel of elastomeric material wherein the at least one resiliently deflectable pelvic support structure provides supplemental support to the seat occupant when the panel of elastomeric material is deflected to cause the panel of elastomeric material to contact the at least one resiliently deflectable pelvic support structure;

a rigidifying member secured to the framework wherein the rigidifying member is U-shaped with a rear leg fixed to the posterior portion of the framework, a left leg fixed to the left portion of the framework, and a right leg fixed to the right portion of the framework whereby rigidified lateral and rear portions of the framework are established; and a peripheral framework of resiliently compressible foam retained on the framework wherein the peripheral framework of resiliently compressible foam has an outer portion of relatively hard foam and an inner portion of relatively soft foam whereby the inner and outer portions cooperate to establish a cradle for a seated occupant.

13. A seat with pelvic support, the seat comprising:

a seat bottom with a framework with a central area defined by an anterior portion, a posterior portion, and left and right portions;

a panel of elastomeric material retained under an initial tension spanning the framework for providing initial support to a seat occupant;

at least one resiliently deflectable pelvic support structure retained in spaced relation from the panel of elastomeric material wherein the at least one resiliently deflectable pelvic support structure provides supplemental support to the seat occupant when the panel of elastomeric material is deflected to cause the panel of elastomeric material to contact the at least one resiliently deflectable pelvic support structure; and a seat back with a back frame and a panel of elastomeric material retained spanning the back frame and a support and positioning member retained in a fixed angular orientation relative to the seat bottom wherein the support and positioning member is retained by the seat back wherein the back frame has peripheral upper, lower, left, and right legs that cooperate to define a central area, a left rigidifying leg fixed to the lower and left leg, and a right rigidifying leg fixed to the lower and right leg, and wherein the support and positioning member is retained by the left and right rigidifying legs.

14. The seat with pelvic support of claim 13 wherein the support and positioning member is retained posterior to the panel of elastomeric material of the seat back.

* * * * *